United States Patent [19]

Maly et al.

[11] 4,192,375

[45] Mar. 11, 1980

[54] GRAVEL-PACKING TOOL ASSEMBLY

[75] Inventors: George P. Maly, Newport Beach; Archibald M. Laurie, Santa Barbara, both of Calif.

[73] Assignee: Union Oil Company of California, Brea, Calif.

[21] Appl. No.: 968,483

[22] Filed: Dec. 11, 1978

[51] Int. Cl.[2] ..... E21B 43/04

[52] U.S. Cl. ..... 166/51; 166/128

[58] Field of Search ..... 166/51, 127, 128, 334

[56] References Cited

U.S. PATENT DOCUMENTS

| | | | |
|---|---|---|---|
| 3,153,451 | 10/1964 | Chancellor et al. | 166/51 |
| 3,627,046 | 12/1971 | Miller et al. | 166/51 X |
| 3,637,010 | 1/1972 | Maly et al. | 166/51 |
| 3,802,500 | 4/1974 | Schmidt | 166/173 X |

*Primary Examiner*—James A. Leppink
*Assistant Examiner*—Richard E. Favreau
*Attorney, Agent, or Firm*—Dean Sandford; Daniel R. Farrell

[57] ABSTRACT

An improved gravel-packing tool assembly with a baffled stinger pipe for gravel-packing a perforate liner having substantially the same internal diameter as the casing string extending from the perforate liner to the earth surface. A perforate nipple and a swab cup are provided between the check valve and the baffled stinger pipe of the tool assembly to allow drainage of the annulus above the tool assembly through the stinger pipe to thereby avoid swabbing the well as the tool is retrieved from the well.

5 Claims, 2 Drawing Figures

GRAVEL-PACKING TOOL ASSEMBLY

BACKGROUND OF THE INVENTION

1. Field of the Invention

This invention relates to the completion of wells in subterranean formations, and more particularly to an apparatus for gravel-packing a void space exterior to a perforate liner installed in a well.

2. Description of the Prior Art

Recovering fluids, such as oil, gas and water, through a well from an unconsolidated or loosely consolidated subterranean formation often results in the undesirable flow of sand and other earth particles into the well. The particles can plug the flow channels of the formation and/or the well, and when entrained in the recovered fluid the particles can cause severe erosion of the metal surfaces of equipment, such as the production string, valves, pumps and flow lines, with which it comes in contact. Moreover, treatment of the produced fluid is generally required to remove the sand. Similar problems can occur during the injection of various fluids through a well into unconsolidated or loosely consolidated formations.

One conventional technique for completing a well in an incompetent formation so as to substantially prevent entrainment of earth particles into the well involves placing a perforate liner in the well at the lower end of a cemented casing string or well liner, and to thereafter pack gravel of selected size around the exterior of the perforate liner in the annular void space between the perforate liner and the walls of the borehole. The gravel can by hydraulically placed in the void space by circulating a suspension of the gravel in water or other liquid through the void space so that the gravel is deposited therein. Conventionally, the perforate liner is run into the well on a gravel-packing tool suspended from a running-in- string. The gravel-packing tool includes a crossover tool, a port collar, a check valve, and a stringer pipe. The crossover tool provides a first flow passage from the interior of the running-in string via the port collar to the void space surrounding the perforate liner, and a second flow passage from the interior of the stringer pipe through the check valve to the annulus above the tool between the running-in string and the well casing or well liner. The crossover tool is suitably packed off above and below the port collar. The stringer pipe is suspended below the crossover tool and check valve and extends to a point just above the lower end of the perforate liner. In operation, the gravel suspension is pumped down the running-in string and through the crossover tool and then outwardly through the gravel ports in the port collar into the void space between the walls of the borehole and the upper end of the perforate liner, whereupon the suspension flows downwardly through the annulus surrounding the perforate liner. The inflowing gravel suspension displaces the carrier liquid of the preceding suspension through the perforations in the perforate liner and into the lower end of the stringer pipe. The carrier fluid passes upwardly through the stringer pipe and check valve, outwardly through the crossover tool and then upwardly through the well annulus surrounding the running-in string above the gravel-packing tool for return to the earth surface.

Ideally, the suspension thus pumped into the upper end of the void space between the perforate liner and the formation wall will gradually move downwardly displacing the liquid already in this annulus inwardly through the perforations in the perforate liner. As the suspension reaches the bottom of the void space, the carrier liquid also passes through the perforations in the perforate liner, progressively leaving the gravel compactly packed in the void space surrounding the perforate liner, from the bottom of the well upward, until no more gravel suspension can be pumped into the upper end of the void space. Unfortunately, this process often does not operate as desired, even in substantially vertical wells, resulting in the void space surrounding the perforate liner being only partially filled with gravel. One of the theories for such failure is that bridging of the gravel between the perforate liner and the formation wall occurs at a point located a substantial distance above the top of the previously placed gravel bed, thus blocking further downward flow of the gravel suspension. After such a bridge occurs, the liquid in the suspension delivered into the void space above the bridge escapes inwardly through the perforate liner. The void space is progressively packed with gravel from the bridge upward leaving a gap in the gravel pack below the bridge. In practice, a number of such bridges may occur in long perforate liners, leaving a like number of gaps in the gravel pack.

Another problem encountered in the gravel-packing of wells in size segregation of gravel within the annulus. Since gravity is a major factor in the formation of a uniform gravel pack, the larger, more dense particles tend to settle faster, which can result in a particle size segregation in the gravel pack.

These problems have been largely overcome by the use of the gravel-packing tools disclosed in U.S. Pat. Nos. 3,637,010 and 3,741,301 to Maly and Robinson and in U.S. Pat. No. 3,802,500 to Schmidt. These tools include a plurality of flexible, radial baffles slidably mounted at spaced positions along the stringer pipe such that the gravel-packing tool is rotatable and axially movable within the perforate liner, within a limited distance, independent of the baffles. The baffles are slightly larger in diameter than the inside diameter of the perforate liner and therefore they offer substantial residence to the flow of fluid past the baffles in the perforate liner. These gravel-packing tools have been used successfully in the gravel-packing of perforate liners having internal diameters which are substantially smaller than the internal diameter of the casing string and/or well liner in the upper portion of the well.

When the perforate liner to be gravel-packed has substantially the same internal diameter as the casing string or well liner extending from the perforate liner to the earth surface, such as a perforate liner attached to a production casing, the gravel-packing tool is normally also provided with a bypass tool, such as a sliding valve, for bypassing the check valve when the gravel-packed tool is retrieved from the well. During retrieval of the gravel-packing tool the bypass tool would normally allow the fluid in the well annulus above the gravel-packing tool to bypass the check valve and drain through the annulus between the stringer pipe and the casing string. However, the presence of one or more baffles on the stringer pipe serves to severely restrict flow through this annulus and as a result the baffles would effectively swab the well fluids from the casing string as the baffled stringer pipe is retrieved. As is known, the swabbing of a well can result in a blowout or other dangerous well conditions. Since the use of a baffled stringer pipe is highly preferred for the gravel-packing of all wells, a need exists for a gravel-packing tool having a baffled stringer pipe which can be safely retrieved without swabbing the casing string through which it must pass.

Accordingly, a primary object of the present invention is to provide a gravel-packing tool with which a compact uniform bed of gravel can be hydraulically placed in a void space exterior to a perforate liner disposed in a well adjacent an incompetent formation.

Another object of this invention is to provide a gravel-packing tool having a baffled stringer pipe which can be safely withdrawn from the well after completion of the gravel-packing operation.

Yet another object of this invention is to provide a gravel-packing tool having a baffled stringer pipe which is suitable for forming a gravel pack around a perforate liner having substantially the same internal diameter as the casing string or well liner which extends from the perforate liner to a point near or at the earth surface.

Further objects, advantages and features of the invention will become apparent to those skilled in the art from the following description taken in conjunction with the accompanying drawings.

SUMMARY OF THE INVENTION

Briefly, the invention provides a tool assembly suitable for gravel-packing a perforate liner having substantially the same diameter as the casing string extending from the perforate liner to the earth surface. The tool assembly comprises (1) a crossover tool adapted for connection to a running-in string, (2) a sliding valve, a check valve, a perforate pipe nipple and one or more swab cups successively coupled from a pipe suspended from the crossover tool, and (3) a baffled stinger pipe coupled to the perforated nipple. The sliding valve and perforate nipple allow drainage of fluid from the annulus above the tool assembly surrounding the running-in string past the tool assembly and through the stinger pipe as the tool assembly is withdrawn from the well. The swab cups prohibit short circuit flow of the gravel-packing slurry carrier fluid through the perforate nipple during the gravel-packing operation.

BRIEF DESCRIPTION OF THE DRAWINGS

The invention will be more readily understood by reference to the drawings, wherein like numerals refer to like elements, in which.

DETAILED DESCRIPTION OF THE INVENTION

The tool assembly of this invention is suitable for use in forming a gravel pack in a void space exterior to a perforate liner disposed in a well and finds particular utility in gravel-packing wells having a downhole configuration which would tend to result in a swabbing of well fluids when a conventional gravel-packing tool having a baffled stinger pipe is retrieved from the well.

As used herein, the term "perforate liner" is intended to include well screens, slotted liners, perforated liners and all their practical equivalents. The size and shape of the fluid flow apertures in the perforate liner for a particular well are selected according to factors well known in the art including, inter alia, the size of the movable earth particles and the size of the gravel being used to form the gravel pack. Similarly, the term "perforate nipple" is intended to include pipe nipples having slots, perforations or other fluid flow apertures.

Figure 1:
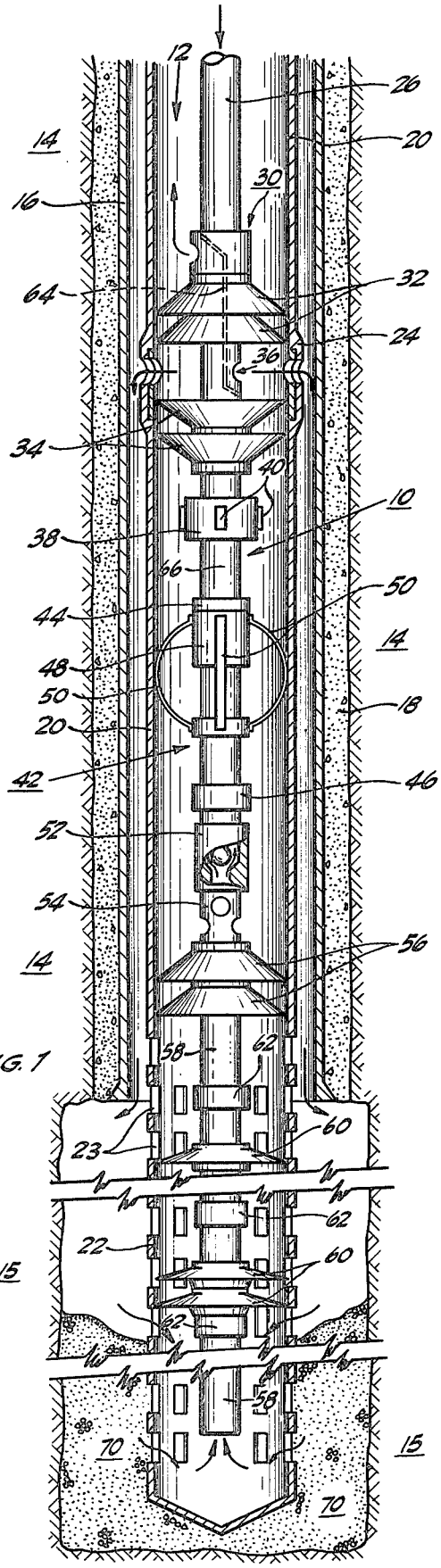
FIGS. 1 and 2 are diagrammatic vertical sectional views illustrating one embodiment of the assembled gravel-packing tool assembly of this invention in place in a well penetrating a subterranean formation during the gravel-packing operation and during retrieval of the tool assembly from the well, respectively.

Referring to FIG. 1, one embodiment of the gravel-packing tool assembly of this invention, shown generally as 10, is disposed in well 12 which penetrates subterranean formation 14. The upper portion of well 12 is cased down to producing zone 15 with tubular casing 16 which has been cemented in place in a conventional manner with cement 18. The lower portion of well 12 can be underreamed, as illustrated, to provide an enlarged borehole in producing zone 15 to contain the gravel pack. Tubular casing string 20 and integral tubular slotted liner 22 are disposed in well 12 such that slots 23 of liner 22 are adjacent producing zone 15 and casing string 20 extends from slotted liner 22 to a point at or near the earth surface. Port collar 24 is disposed in casing string 20 at a spaced position above slotted liner 22.

Tool assembly 10 is positioned in casing string 20 and slotted liner 22 by means of running-in string 26. Proceeding from top to bottom, tool assembly 10 includes (1) crossover tool 30 having a pair of downwardly facing swab cups 32 and a pair of upwardly facing swab cups 34 which straddle gravel port 36 of crossover tool 30; (2) dog holder 38 having one or more spring-actuated dogs 40 for opening and closing port collar 24; (3) sliding valve 42 having upper stop 44, lower stop 46 and closure element 48 which is slidably held between stop 44 and stop 46 by drag springs 50; (4) check valve 52; (5) pipe nipple 54 which comprises a conduit having one or more apertures; (6) downwardly facing swab cups 56; and (7) baffled stinger pipe 58 having a plurality of baffles 60 slidably mounted between pup joints 62 at a plurality of spaced locations along the length of stinger pipe 58. Baffled stinger pipe 58 and baffles 60 are more fully described in U.S. Pat. Nos. 3,637,010 and 3,741,301 to Maly and Robinson and U.S. Pat. No. 3,802,500 to Schmidt, the disclosures of which are herein incorporated by reference.

On opposite sides of interior wall 64 (indicated by dotted lines), crossover tool 30 provides fluid-tight communication through a first passageway between the interior of running-in string 26 through gravel port 36 to the annulus between crossover tool 30 and casing string 20 which is confined between swab cups 32 and swab cups 34 and subsequently through port collar 24 to the underreamed section of well 12, and further provides fluidtight communication through a second passageway between the interior of pipe 66 and the well annulus above swab cups 32 between running-in string 26 and casing string 20.

Check valve 52 allows fluid flow from stinger pipe 58 upwardly through the interior of pipe 66 but prohibits the draining of fluid in pipe 66 through stinger pipe 58. Sliding valve 42 is provided as a means for bypassing check valve 52 when it is desirable to drain fluid from pipe 66, such as during retrieval of tool assembly 10 from well 12. Sliding valve 42 is operated by raising and/or lowering tool assembly 10 within casing string 20. Slidable element 48 is freely slidable between upper stop 44 and lower stop 46. Drag springs 50 which engage the interior wall of casing string 20 hold slidable element 48 in either the upper, closed position or the lower, open position depending upon whether tool assembly was most recently raised (opening the sliding valve) or lowered (closing the sliding valve).

Tool assembly 10 is assembled from its component parts in the appropriate lengths and spacings dictated by the downhole configuration of the well to be gravel-packed. Tool assembly 10 must be assembled such that, when swab cups 32 and 34 straddle port collar 24, sliding valve 42, check valve 52, pipe nipple 54 and swab cups 56 are positioned in a blank portion of casing string 20 above slots 23 of slotted liner 22, i.e., there must be no slots or other apertures which allow fluid entry into casing string 20 at a point between swab cups 34 and swab cups 56, as illustrated. Baffles 60 are suitably mounted in groups of from 1 to 5 baffles at spaced intervals, such as about 2 to about 10 feet, along the length of stinger pipe 58. Preferably baffled stinger pipe 58 extends substantially the entire length of slotted liner 22.

A typical tool assembly of this invention will be described, by way of example, with respect to a particular well configuration. A well penetrating a subterranean formation has a nominal 9⅝-inch cemented casing through which extends an integral casing string and slotted liner of nominal 7-inch diameter. The slotted liner is positioned adjacent to an underreamed producing zone of the formation having a length of about 475 feet. First, about 450 feet of a baffled stinger pipe described in the aforementioned U.S. patents is run into the casing string at the top of the well. Two downwardly facing swab cups are attached to the bottom of a one foot pipe nipple of nominal 2½-inch pipe having about twelve 1-inch diameter perforations located above the swab cups. The pipe nipple is coupled to the top of the baffled stinger pipe. Then, in succession, a check valve, sliding valve and straddle tool marketed by the Baker Sand Control Corporation under the trademarks "Burns Check Valve," "Burns Sliding Valve" and "Burns Four-Cup Straddle Tool", respectively, are attached to the top of the pipe nipple. This tool assembly is then attached to a nominal 2½-inch running-in string. Thus, the tool assembly of this invention can be assembled from commerically available component parts.

During the gravel-packing operation, tool assembly 10 is run into well 12 by means of running-in string 26. Port collar 24 is opened by means of dogs 40 and manipulation of running-in string 26, and then tool assembly 10 is lowered to the gravel-packing position, i.e., the position wherein swab cups 32 and 34 straddle port collar 24, and pipe nipple 54 and swab cups 56 are adjacent a blank section of casing string 20 above slotted liner 22. Sliding valve 42 is automatically closed as tool assembly is lowered to the gravel-packing position. A slurry comprised of gravel and a carrier liquid is then flowed downwardly through running-in string 26 and crossover tool 30, outwardly through gravel port 36 and port collar 24 and downwardly through the annulus between casing 16 and casing string 20 into the underreamed cavity surrounding slotted liner 22. The gravel settles to form gravel pack 70 and the carrier liquid flows through the slots of slotted liner 22 into the bottom of stinger pipe 58. The carrier liquid then flows upwardly through stinger pipe 58, check valve 52, pipe 66, crossover tool 30 and the annulus between running-in string 26 and casing string 20 as it is returned to the earth surface.

As disclosed in the aforementioned U.S. Patents, baffles 60 serve to prevent the formation of bridges and gaps in gravel pack 70, thereby providing a stable, uniform gravel pack. The baffled stinger pipe provides a significant improvement in the uniformity of the gravel pack in straight wells, such as a 5 percent or better improvement. The improvement achieved in inclined wells is significantly greater, particularly where relatively long intervals of a producing zone are to be gravel-packed.

The presence of swab cups 56 in an unperforated section of casing string 20 serves to prohibit flow of the carrier liquid through pipe nipple 54 into pipe 66, thereby preventing a short circuit flow which could reduce the beneficial effect of the baffled stinger pipe.

After completion of the gravel-packing operation, port collar 24 is closed by means of dogs 40 and manipulation of running-in string 26, and excess gravel is removed from running-in string by circulating fluid down the well annulus, past swab cups 32 and through gravel port 36 and crossover tool 30 into running-in string 26. During this circulation step, check valve 52 serves to prohibit overpressuring of producing zone 15.

Figure 2:
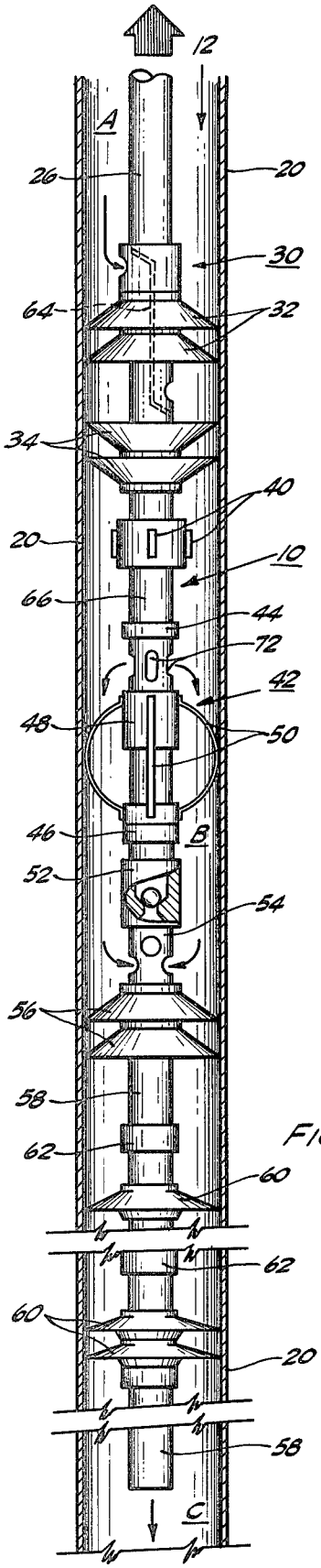

Referring to FIG. 2, tool assembly 10 is then retrieved from the well by pulling running-in string 26 and tool assembly 10 upwardly through casing string 20. The raising of tool assembly 10 automatically opens sliding valve 42 since drag springs 50 drag slidable element 48 to the down, open position against bottom stop 46, thereby uncovering bypass ports 72.

As tool assembly 10 is pulled through casing string 20, it is desirable to allow the fluid in the annulus above swab cups 32 between running-in string 26 and casing string 20 (indicated in FIG. 2 as "A" and hereinafter referred to as annulus A) to drain through and/or around tool assembly 10 into the section of well 12 below stinger pipe 58 (indicated in FIG. 2 as "C"). Failure to drain the fluid in either annulus A or running-in string 26 into section C, particularly in the case of a rapid retrieval of tool assembly 10, results in a swabbing of the well—a potentially dangerous condition.

The embodiment of the tool assembly of this invention which is illustrated in FIG. 2 allows proper drainage of the fluid in annulus A through crossover tool 30 and bypass ports 72 into the annulus surrounding check valve 52 (illustrated as "B" and hereinafter referred to as annulus B) and then through pipe nipple 54 and stinger pipe 58 into section C. Thus, crossover tool 30, pipe 66 and bypass ports 72 provide a fluid passageway with which to bypass swab cups 32 and 34, and bypass ports 72, annulus B, perforate nipple 54 and stinger pipe 58 provide a fluid passageway with which to bypass check valve 52 and baffles 60. Accordingly, the tool assembly of this invention provides an effective tool for forming uniform gravel packs in wells and also allows free drainage of fluid through the tool during its retrieval from the well.

While the invention has been described with respect to the gravel-packing of an underreamed space surrounding a perforate liner in an open hole, the tool assembly can be successfully employed to gravel-pack other void spaces exterior to a perforate liner which are in fluid communication with the well. For example, the tool assembly of this invention can be used to gravel pack the annular space between a cemented, perforated casing string and a perforate liner, and at the same time to gravel pack void spaces in the formation behind the cemented casing string which were formed by "washing out" perforations made with a gun or jet perforator.

The diameters, lengths and other dimensions of the tool assembly of this invention may be varied according to the configuration of the well to be gravel-packed. Such variations are within the skill of the art and therefore need not be described more fully herein. The number and size of the apertures in pipe nipple 54 are selected to minimize the pressure drop in draining fluid therethrough while at the same time providing a strong connection with which to suspend baffled stinger pipe 58 from the rest of tool assembly 10. Preferably the apertures, such as perforations or slots, in pipe nipple 54 provide a cross-sectional area for flow of at least about 1, more preferably between about 1.5 and about 5 times the cross-sectional area of stinger pipe 58 and/or pipe 66.

While particular embodiments of the invention have been described, it will be understood, of course, that the invention is not limited thereto since many obvious modifications can be made, and it is intended to include within this invention any such modification as will fall within the scope of the appended claims.

Having now described the invention, we claim:

1. A tool assembly adapted for placement in a well for the purpose of forming a bed of granular material in a void space exterior to a perforate liner having substantially the same internal diameter as a casing string extending from said liner substantially to the earth surface, said tool assembly comprising:

crossover means adapted for connection with a tubing string and for placement in said well in sealable engagement with the interior of said casing string to thereby separate the interior of said casing string and said liner into an upper section above said crossover means and a lower section below said crossover means, and adapted to provide fluid communication through a first passageway from the interior of said tubing string via a gravel port in said casing string to said void space and through a second passageway from the interior of a pipe extending from said crossover means into said lower section to a first annular space which surrounds said tubing string in said upper section;

check valve means adapted to allow fluid flow upwardly through said second passageway and to prohibit fluid flow downwardly through said second passageway;

bypass means coupled to and interposed between said pipe and said check valve means and adapted to selectively allow drainage of fluid from said first annular space downwardly through said second passageway and the interior of said pipe via said bypass means to a second annular space which surrounds said check valve means;

a pipe nipple coupled to said check valve means and having one or more apertures which allow fluid communication between said second annular space and the interior of said pipe nipple;

one or more annular swab cups attached to the portion of said pipe nipple below said apertures and adapted for sealable engagement with the interior of said casing string to thereby substantially prohibit fluid flow upwardly past said swab cups through the space between said pipe nipple and said casing string, said nipple and said swab cups being positioned in said tool assembly such that, upon placement of said tool assembly in said well, the apertures of said pipe nipple and said swab cups are adjacent a blank portion of said casing string spaced above the apertures of said perforate liner; and a baffled stinger pipe coupled to the bottom of said pipe nipple and having a plurality of annular yieldable baffles mounted at spaced intervals along said stinger pipe, each of said baffles being adapted to offer substantial resistance to fluid flowing in said casing string or said perforate liner past said baffles.

2. The tool assembly defined in claim 1 wherein the apertures of said pipe nipple define a combined cross-sectional area for fluid flow of at least about the cross-sectional area for fluid flow through said stinger pipe.

3. The tool assembly defined in claim 1 wherein the apertures of said pipe nipple define a combined cross-sectional area for fluid flow of between about 1.5 and about 5 times the cross-sectional area for fluid flow through said stinger pipe.

4. The tool assembly defined in claim 1 wherein a plurality of said baffles are mounted on said stinger pipe in groups of between 1 and about 5 baffles and wherein said groups are spaced on said stinger pipe at intervals of about 2 feet to about 10 feet.

5. A tool assembly adapted for placement in a well for the purpose of forming a bed of granular material in a void space exterior to a perforate liner having substantially the same internal diameter as a casing string extending from said liner substantially to the earth surface, said tool assembly comprising:

crossover means adapted for connection with a tubing string and for placement in said well in sealable engagement with the interior of said casing string to thereby separate the interior of said casing string and said liner into an upper section above said crossover means and a lower section below said crossover means, and adapted to provide fluid communication through a first passageway from the interior of said tubing string via a gravel port in said casing string to said void space and through a second passageway from the interior of a pipe extending from said crossover means into said lower section to a first annular space which surrounds said tubing string in said upper section;

a check valve adapted to allow fluid flow upwardly through said check valve and to prohibit fluid flow downwardly through said check valve;

a sliding valve coupled to the bottom of said pipe and to the top of said check valve, said sliding valve having means for selectively allowing drainage of fluid from said first annular space downwardly through said second passageway and the interior of said pipe via said sliding valve to a second annular space which surrounds said check valve;

a pipe nipple coupled to the bottom of said check valve and having a plurality of apertures which define a total cross-sectional area for fluid flow of at least about the cross-sectional area for fluid flow through said pipe, said apertures being adapted to allow fluid flow between said second annular space and the interior of said pipe nipple;

one or more swab cups attached to a portion of said pipe nipple below said apertures and adapted for sealable engagement with the interior of said casing string to thereby substantially prohibit fluid flow upwardly past said swab cups through the space between said pipe nipple and said casing string, said pipe nipple and said swab cups being positioned in said tool assembly such that, upon placement of said tool assembly in said well, the apertures of said pipe nipple and said swab cups are adjacent a blank portion of said casing string spaced above the apertures of said perforate liner; and a baffled stinger pipe coupled to the bottom of said pipe nipple and having a plurality of annular yieldable baffles which are slidably mounted in groups of between about 1 and about 5 baffles at spaced intervals of about 2 feet to about 10 feet long said stinger pipe, each of said baffles being adapted to offer substantial resistance to fluid flowing in said casing string or said perforate liner past said baffles.

* * * * *